US012181216B2

(12) United States Patent
Jin et al.

(10) Patent No.: US 12,181,216 B2
(45) Date of Patent: Dec. 31, 2024

(54) METHOD TO CONTROL THE COOLDOWN OF MAIN HEAT EXCHANGERS IN LIQUEFIED NATURAL GAS PLANT

(71) Applicant: Air Products and Chemicals, Inc., Allentown, PA (US)

(72) Inventors: Bo Jin, Orefield, PA (US); Matthew Joseph Okasinski, Harleysville, PA (US); Fei Chen, Whitehouse Station, NJ (US)

(73) Assignee: Honeywell LNG LLC, Wilmington, DE (US)

( * ) Notice: Subject to any disclaimer, the term of this patent is extended or adjusted under 35 U.S.C. 154(b) by 542 days.

(21) Appl. No.: 17/399,240

(22) Filed: Aug. 11, 2021

(65) Prior Publication Data

US 2022/0074654 A1 Mar. 10, 2022

Related U.S. Application Data

(60) Provisional application No. 63/074,565, filed on Sep. 4, 2020.

(51) Int. Cl.
*F25J 1/02* (2006.01)
*F25J 1/00* (2006.01)

(52) U.S. Cl.
CPC ..... *F25J 1/0247* (2013.01); *F25J 1/0022* (2013.01); *F25J 1/0254* (2013.01); *F25J 2270/66* (2013.01); *F25J 2280/10* (2013.01)

(58) Field of Classification Search
CPC ..... F25J 1/0249; F25J 1/0247; F25J 1/0252; F25J 1/0254; F25J 1/0243; F25J 1/0244; F25J 1/0255; F25J 1/0262; F25J 3/0295; F25J 3/04478; F25J 3/04484; F25J 3/04763; F25J 3/04769; F25J 3/04848; F25J 3/0695
See application file for complete search history.

(56) References Cited

U.S. PATENT DOCUMENTS

| | | | | |
|---|---|---|---|---|
| 3,167,113 | A * | 1/1965 | Kleiss | F28F 27/00 700/285 |
| 10,393,429 | B2 | 8/2019 | Chen et al. | |
| 2007/0107465 | A1 | 5/2007 | Turner et al. | |
| 2010/0326133 | A1 | 12/2010 | Beeby et al. | |
| 2017/0292783 | A1 * | 10/2017 | Chen | F25J 1/0072 |
| 2018/0017320 | A1 | 1/2018 | Bahari et al. | |

FOREIGN PATENT DOCUMENTS

| | | |
|---|---|---|
| EP | 3486588 | 5/2016 |

* cited by examiner

*Primary Examiner* — Frantz F Jules
*Assistant Examiner* — Webeshet Mengesha
(74) *Attorney, Agent, or Firm* — Design IP

(57) ABSTRACT

A method to control the cooldown of main heat exchangers in liquefied natural gas plant. The method provides for the automated control of a flow rate of a natural gas feed stream through a heat exchanger based on one or more process variables and set points. The flow rate of refrigerant streams through the heat exchanger is controlled by different process variables and set points, and is controlled independently of the flow rate of the natural gas feed stream.

13 Claims, 6 Drawing Sheets

METHOD TO CONTROL THE COOLDOWN OF MAIN HEAT EXCHANGERS IN LIQUEFIED NATURAL GAS PLANT

CROSS-REFERENCE TO RELATED APPLICATIONS

This application claims the priority of U.S. Provisional Application No. 63/074,565 filed on Sep. 4, 2020, which is incorporated by reference herein in its entirety.

BACKGROUND

A number of liquefaction systems for cooling, liquefying, and optionally sub-cooling natural gas are well known in the art, such as the single mixed refrigerant (SMR) cycle, propane pre-cooled mixed refrigerant (C3MR) cycle, dual mixed refrigerant (DMR) cycle, C3MR-Nitrogen hybrid (such as the AP-X® process) cycles, nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and optionally pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Each refrigerant compression system includes a compression circuit for compressing and cooling the circulating refrigerant, and a driver assembly to provide the power needed to drive the compressors. The refrigerant is compressed to high pressure and cooled prior to expansion in order to produce a cold low pressure refrigerant stream that provides the heat duty necessary to cool, liquefy, and optionally sub-cool the natural gas.

Various heat exchangers may be employed for natural gas cooling and liquefaction service. Coil Wound Heat Exchangers (CWHEs) are often employed for natural gas liquefaction. CWHEs typically contain helically wound tube bundles housed within an aluminum or stainless steel pressurized shell. For LNG service, a typical CWHE includes multiple tube bundles, each having several tube circuits.

In a natural gas liquefaction process, natural gas is typically pre-treated to remove impurities such as water, mercury, acid gases, sulfur-containing compounds, heavy hydrocarbons, etc. The purified natural gas is optionally pre-cooled prior to liquefaction to produce LNG.

Prior to normal operation of the plant, all the unit operations in the plant need to be commissioned. This includes start-up of natural gas pretreatment process if present, refrigerant compressors, pre-cooling and liquefaction heat exchangers, and other units. The first time a plant is started up is hereafter referred to as "initial start-up." The temperature that each portion of a heat exchanger operates at during normal operation is referred to as the "normal operating temperature." The normal operating temperature of a heat exchanger typically has a profile with the warm end having the highest temperature and the cold end having the lowest temperature. The normal operating temperature of a pre-cooling heat exchanger at its cold end and a liquefaction exchanger at its warm end is typically between −10 degrees C. and −60 degrees C. depending on the type of pre-cooling refrigerant employed. In the absence of pre-cooling, the normal operating temperature of a liquefaction heat exchanger at its warm end is near ambient temperature. The normal operating temperature of a liquefaction heat exchanger at its cold end is typically between −100 degrees C. and −165 degrees C., depending on the refrigerant employed and whether it is performing optional sub-cooling. Therefore, initial start-up of these types of exchangers involves cooling the cold end from ambient temperature (or pre-cooling temperature) to normal operating temperature and establishing proper spatial temperature profiles for subsequent production ramp-up and normal operations.

An important consideration while starting up pre-cooling and liquefaction heat exchangers is that they must be cooled down in a gradual and controlled manner to prevent thermal stresses to the heat exchangers. It is desirable that the rates of change in temperature within the exchanger are within acceptable limits. Not doing so may cause thermal stresses to the heat exchangers that can impact mechanical integrity, and overall life of the heat exchangers that may eventually lead to undesirable plant shutdown, lower plant availability, and increased cost. Therefore, care must be taken to ensure that heat exchanger cool-down is performed in a gradual and controlled manner.

The need to start-up the heat exchangers may also be present after the initial start-up of the plant, for instance during restart of the heat exchangers following a temporary plant shutdown or trip. In such a scenario, the heat exchanger may be warmed up from ambient temperature, hereafter referred to as "warm restart" or from an intermediate temperature between the normal operating temperature and ambient temperature, hereafter referred to as "cold restart." Both cold and warm restarts must also be performed in a gradual and controlled manner. The terms "cool-down" and "start-up" generally refer to heat exchanger cool-down during initial start-ups, cold restarts as well as warm restarts.

One approach is to manually control the heat exchanger cool-down process. The refrigerant flow rates and composition are manually adjusted in a step-by-step manner to cool down the heat exchangers. This process requires heightened operator attention and skill, which may be challenging to achieve in new facilities and facilities with high operator turnover rate. Any error on the part of the operator could lead to cool down-rate exceeding allowable limits and undesirable thermal stresses to the heat exchangers. Additionally, in the process, the rate of change of temperature is often manually calculated and may not be accurate. Further, manual start-up tends to be a step-by-step process and often involves corrective operations, and therefore is time consuming. During this period of start-up, feed natural gas from the exchanger is typically flared since it does not meet product requirements or cannot be admitted to the LNG tank. Therefore, a manual cool-down process would lead to large loss of valuable feed natural gas.

Another approach is to automate the cool-down process with a programmable controller for example in the system disclosed in US 2010/0326133 A1. The approaches disclosed in the prior art are overly complicated and do not involve feed valve manipulations until the exchanger has already cooled down. This can easily lead to a large oversupply of refrigerant in the heat exchanger and would be inefficient. In the case of a two-phase refrigerant such as mixed refrigerant (MR), this could lead to liquid refrigerant at the suction of the MR compressor. Additionally, this method does not take advantage of the close interactions between the feed flow rate and refrigerant flow rate, which have a direct impact on hot and cold side temperatures. Finally, this method is rather an interactive (not automatic) process with the crucial decisions still having to be made by the operator. Its level of automation is limited.

One potential way to automate the cool down process would be to increase the natural gas feed flow rate while independently manipulating the refrigerant flow rate to control the cooldown rate as measured at the cold end of the heat exchanger. This method is found to be ineffective, because the cool down rate controller can have different and even reverse responses depending on the temperature and phase behavior of the refrigerant. The refrigerant not only serves as a cooling medium, but also a heat load in the heat exchanger before JT valve expansion. At the beginning of the process, increasing the refrigerant flowrate may cause the cooldown rate as measured at the cold end to actually slow before the refrigerant condenses in the tube circuit. Later in the cooldown process when the refrigerant entering the JT valve is condensed, increasing the flow increases the cool down rate. This reverse response makes the automation of such a control method very difficult or infeasible.

Another method to automate the cool down process is taught by U.S. Ser. No. 10/393,429, which discloses using the derivative of the cold end temperature to control the ramp up (increase in flow) of the natural gas feed stream in the main heat exchanger. Flow rates for the refrigerant streams in the main heat exchanger are controlled using a predetermined ramp rate. The flow rates of the refrigerant streams are not adjusted or controlled based on any time derivative temperature measurement. Using cold end temperature measurements as the only time derivative measurement for controlling flow and ramping up refrigerant stream flows independent of any time derivative temperature measurement can lead to undesirably large temperature fluctuations that propagate through the heat exchanger. These temperature fluctuations can start at cold end and also other locations such as intermediate zone and warm end during the plant startup. Therefore, depending on the location of temperature fluctuation initiation, it can travel in the same or opposite to the direction of feed flow. If the temperature fluctuations start at cold end and then travel toward the warm end, the cold end time derivative temperature controller can be effective to detect this and dampen such temperature fluctuations by adjusting the feed flow. However, if the temperature fluctuations start in some distance away from the cold end (e.g. near the warm end), such fluctuations travel toward the cold end. If the cold end temperatures are the only time derivative temperature measurements used to control flow, it is often impossible to detect these fluctuations before they reach the cold end. Accordingly, by the time fluctuations reach the cold end, it is too late to dampen such temperature fluctuations. For example, FIG. 1 shows a simulated temperature profile for a cold end temperature sensor during cooldown for the system and method disclosed in FIGS. 1-2 of U.S. Ser. No. 10/393,429. The sharp temperature drop shown in FIG. 1 could result in thermal stress on the main heat exchanger.

Overall, what is needed is an improved automated system and method for the start-up of heat exchangers in a natural gas liquefaction facility, that reduces the likelihood of thermal stresses on the main heat exchangers while reducing the need for operator intervention.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The disclosed embodiments satisfy the need in the art by providing a programmable control system and method for adjusting both the feed gas flow rate and at least one refrigerant flow rate during the start-up of a natural gas liquefaction facility as a function of time derivative temperature measurements at different axial locations in a main heat exchanger.

In addition, several specific aspects of the systems and methods of the present invention are outlined below.

Aspect 1: A method for controlling start-up of a heat exchange system having a main heat exchanger comprising a warm end, a cold end, and an intermediate zone, at least one feed stream, and at least one refrigerant stream, the method comprising the steps of:

(a) cooling the main heat exchanger from a first temperature profile at a first time to a second temperature profile at a second time, the first temperature profile having a first average temperature that is greater than a second average temperature of the second temperature profile; and (b) executing the following steps, in parallel during the performance of step (a):

(i) measuring a cold end temperature at the cold end of the main heat exchanger;

(ii) calculating a first value comprising a rate of change of the first cold end temperature;

(iii) providing a cold end set point representing a preferred rate of change of the cold end temperature;

(iv) controlling a flow rate of the at least one feed stream through the main heat exchanger based on the first value and the first set point;

(v) measuring a first intermediate zone temperature at a first location in the intermediate zone of the main heat exchanger;

(vi) calculating a second value comprising a rate of change of the first intermediate zone temperature;

(vii) providing a first intermediate zone set point representing a preferred rate of change of the first intermediate zone temperature; and (viii) controlling a flow rate of a first stream of the at least one refrigerant stream through the main heat exchanger based on the second value and the second set point.

Aspect 2: The method of Aspect 1, wherein step (b) further comprises:

(ix) measuring a second intermediate zone temperature at a second location in the intermediate zone of the main heat exchanger, the second location being located at a different axial location in the intermediate zone than the first location;

(x) calculating a third value comprising a rate of change of the second intermediate zone temperature;

(xi) providing a second intermediate zone set point representing a preferred rate of change of the second intermediate zone temperature; and (xii) controlling a flow rate of a second stream of the at least one refrigerant stream through the main heat exchanger based on the third value and the third set point.

Aspect 3: The method of any of Aspects 1 through 2, wherein the first intermediate zone set point is equal to the cold end set point.

Aspect 4: The method of any of Aspects 1 through 2, wherein the first intermediate zone set point is less than the cold end set point.

Aspect 5: The method of any of Aspects 1 through 4, wherein at least one refrigerant stream comprises an MRL stream and an MRV stream and step (b) further comprises:

(xiii) controlling a flow rate of the MRV stream based on a constant rate of change.

Aspect 6: The method of Aspect 5, wherein step (viii) comprises controlling the flow rate of the MRL stream through the main heat exchanger based on the second value and the second set point.

Aspect 7: The method of any of Aspects 1 through 6, wherein the main heat exchanger comprises a coil-wound heat exchanger.

Aspect 8: The method of any of Aspects 1 through 7, further comprising:

(xiv) pre-cooling the at least one feed stream before introducing the at least one feed stream into the main heat exchanger.

Aspect 9: The method of any of Aspects 1 through 8, wherein step (b)(i) comprises:

(i) measuring the cold end temperature at the cold end of the main heat exchanger, the measured cold end temperature consisting of an average of temperature readings from a first plurality of temperature sensors; and wherein step (b)(v) comprises:

(v) measuring the first intermediate zone temperature at the first location in the intermediate zone of the main heat exchanger, the measured first intermediate zone temperature consisting of an average of temperature readings from a second plurality of temperature sensors.

Aspect 10: The method of any of Aspects 1 through 9, wherein the cold end set point is constant throughout the performance of step (a).

Aspect 11: The method of any of Aspects 1 through 10, wherein the cold end set point changes at least once during the performance of step (a).

Aspect 12: The method of aspects 1 through 11, wherein the first intermediate zone set point is constant throughout the performance of step (a).

Aspect 13: The method of any of Aspects 1 through 12, wherein the first intermediate zone set point changes at least once during the performance of step (a).

Aspect 14: A method for controlling the start-up of a liquefied natural gas plant having a main heat exchanger to achieve cool down of the main heat exchanger by closed loop refrigeration using a mixed refrigerant supplied to the main heat exchanger as an MRL stream and an MRV stream, the main heat exchanger comprising at least one natural gas stream and at least one refrigerant stream, and the at least one refrigerant stream being used to cool the at least one natural gas stream through indirect heat exchange, the main heat exchanger comprising a coil wound heat exchanger having a warm end, a cold end, and an intermediate zone, the method comprising the steps of:

(a) cooling the main heat exchanger from a first temperature profile at a first time to a second temperature profile at a second time, the first temperature profile having a first average temperature that is greater than a second average temperature of the second temperature profile; and (b) executing the following steps, in parallel during the performance of step (a):

(i) measuring a cold end temperature at the cold end of the main heat exchanger;

(ii) calculating a first value comprising a rate of change of the first cold end temperature;

(iii) providing a cold end set point representing a preferred rate of change of the cold end temperature;

(iv) controlling a flow rate of the at least one natural gas stream through the main heat exchanger based on the first value and the first set point;

(v) measuring a first intermediate zone temperature at a first location in the intermediate zone of the main heat exchanger;

(vi) calculating a second value comprising a rate of change of the first intermediate zone temperature; and (vii) providing a first intermediate zone set point representing a preferred rate of change of the first intermediate zone temperature.

Aspect 15: The method of Aspect 14, further comprising: controlling a flow rate of an MRL stream through the main heat exchanger based on the second value and the second set point.

DETAILED DESCRIPTION OF INVENTION

Figure 1:
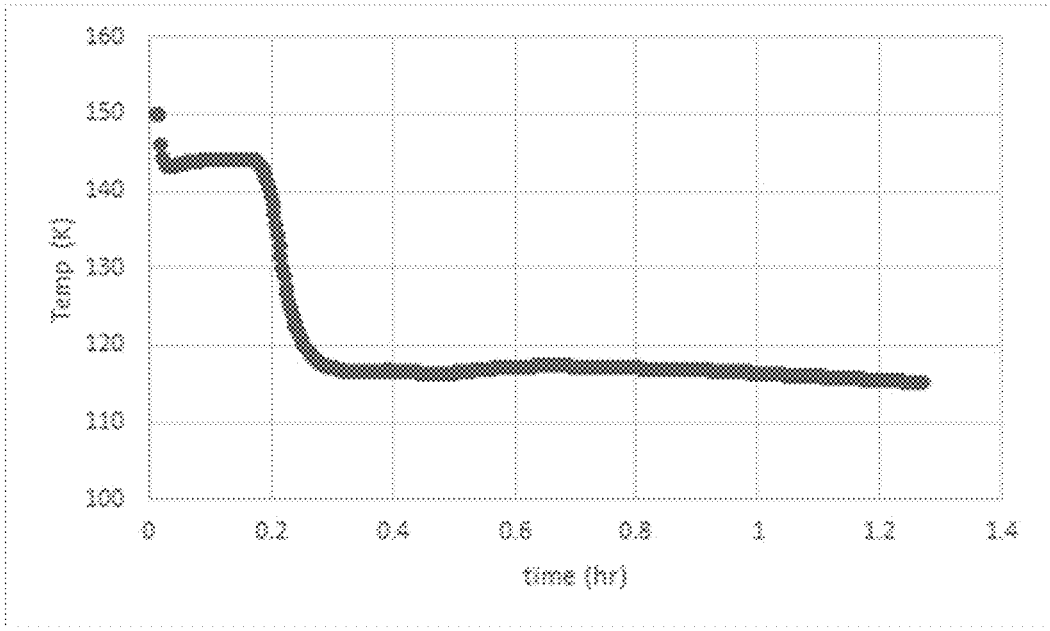
FIG. 1 (PRIOR ART)
FIG. 1 is a graph showing a simulated temperature profile during cool down for the system and method disclosed in U.S. Ser. No. 10/393,429.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention.

Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

In the claims, letters and roman numerals are used to identify claimed steps and substeps (e.g. (a), (b), (c), (i), (ii), and (iii)). These letters and numerals are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

The term "temperature" of a heat exchanger may be used in the specification and claims to describe a thermal temperature of a specific location inside the heat exchanger.

The term "temperature profile" may be used in the specification, examples, and claims to describe a spatial profile of temperature along the axial direction that is in parallel with the flow direction of streams inside the heat exchanger. It may be used to describe a spatial temperature profile of a hot or cold stream, or of the metal materials of the heat exchanger.

Unless otherwise stated herein, any and all percentages identified in the specification, drawings and claims should be understood to be on a molar percentage basis. Unless otherwise stated herein, any and all pressures identified in the specification, drawings and claims should be understood to mean absolute pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "main heat exchanger", as used in the specification and claims, refers to a heat exchanger that cools the feed gas to the desired product temperature. In the case of an LNG plant, the main heat exchanger is the heat exchanger that provides the liquefied (in some cases, sub-cooled) natural gas product. Pre-cooling of the feed gas is performed within the main heat exchanger if the pre-cooling is performed against the same refrigerant as used for the liquefaction of the feed gas. Pre-cooling of the feed gas is performed within a separate pre-cooling heat exchanger if the pre-cooling is performed against a different refrigerant than used for the liquefaction of the feed gas. A main heat exchanger may have multiple stages or bundles, which may be provided within a single vessel or multiple vessels that are in fluid flow communication. In a system in which the cold end of the main heat exchanger operates at cryogenic temperatures, the main heat exchanger may also be known as a "main cryogenic heat exchanger" or "MCHE".

The term "time derivative temperature" is intended to be synonymous with the rate of change of temperature (e.g., degrees K per hour).

The term "natural gas", as used in the specification and claims, means a hydrocarbon gas mixture consisting primarily of methane A hydrocarbon gas is gas comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compression stage and ending downstream from the last compressor or compressor sage. The term "compression sequence" is intended to refer to the steps performed by the components and conduits that comprise the associated compression circuit.

As used in the specification and claims, the terms "high-high", "high", "medium", and "low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "warm stream" or "hot stream" is intended to mean a fluid stream that is cooled by indirect heat exchange under normal operating conditions of the system being described. Similarly, the term "cold stream" is intended to mean a fluid stream that is warmed by indirect heat exchange under normal operating conditions of the system being described.

Figure 2:
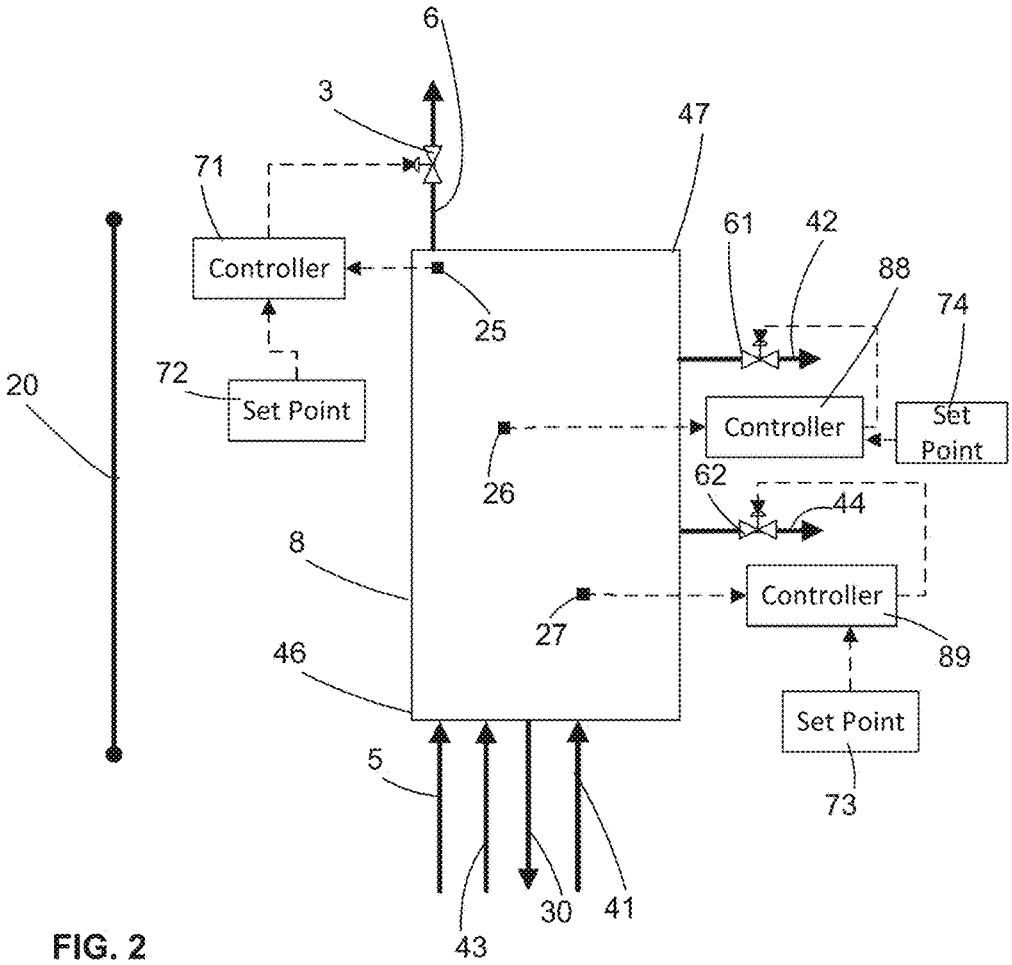
FIG. 2 is a simplified schematic flow diagram of an exemplary main heat exchanger system.

Referring the FIG. 2, a simplified exemplary coil wound heat exchanger 8 having a warm end 46 and a cold end 47 is shown, which are arranged along an axis 20 of feed stream flow. The heat exchanger 8 cools a feed gas stream 5 and refrigerant streams 41, 43 against refrigerant flowing through the heat exchanger 8, which exits the warm end 46 via stream 30. After cooling, streams 41 and 43 are expanded by JT valves 61 and 62, respectively, to form refrigerant streams 42 and 44, respectively, and are returned (not shown) to heat exchanger 8 to exit via stream 30. The cooled feed gas stream 6 exits the heat exchanger 8 at the cold end 47 and its flow is controlled by a valve 3.

During cool down, the flow rate of the feed gas stream 5 is controlled by a controller 71, which receives temperature measurements from a first sensor 25 located at the cold end 47, calculates a time derivative temperature, compares it to a first set point 72, and adjusts the flow rate of the feed gas stream 5 to maintain the cold end time derivative temperature below the first set point 72. Because this process takes place during a cool down, both the measured time derivative temperature and the first set point are negative values. Accordingly, in this context "below" or "less than" means that the absolute value of the measured time derivative temperature is less than the absolute value of the first set point.

In this example, the flow rate of refrigerant stream 41, is controlled by a controller 88, which receives temperature measurements from a second sensor 26 located at a first intermediate location, calculates a time derivative temperature, compares it to a second set point 74, and adjusts the flow rate of refrigerant stream 42 to maintain the first intermediate time derivative temperature below the second set point 74. As used in this example, the set point is a single value, but in some embodiments of the invention the set point may refer to a range of values for which a controller takes one action if the time derivative temperature is within the range of values, and a different action if the time derivative temperature is outside the range. In addition, the temperature measurements used to calculate time derivative temperatures are shown as being provided by a single temperature measurement from a single sensor. In other embodiments, other configurations could be used. For example, multiple temperature sensors could be used at the same axial location and an average of the measured temperatures could be used as the basis for the time derivative temperature, The flow rate of refrigerant stream 43 is controlled by a controller 89, which receives temperature measurements from a third sensor 27 located at a second intermediate location, calculates a time derivative temperature, compares it to a third set point 73, and adjusts the flow rate of refrigerant stream 44 to maintain the second intermediate time derivative temperature below the third set point 73.

There are many suitable alternate sensor configurations that could be used to provide temperature measurements to each of the controllers 71, 88, 89. For example, a temperature sensor could be placed on a different stream in the cold end 47, a temperature sensor could be placed on any of the streams in a position that is external to the heat exchanger 8, or multiple temperature sensors could be used. If multiple temperature sensors are used to provide the temperature measurement for a single controller, then a calculation would preferably be performed, such as taking an average of the temperatures measured at a given point in time by the temperature sensors.

In most applications, it is preferable that the feed gas flow rate be controlled based on time derivative temperature measurements taken at the cold end 47 of the heat exchanger 8 and that the flow of at least one refrigerant stream is controlled based on time derivative temperature measurements taken in the intermediate zone of the heat exchanger 8. The preferred number of refrigerant stream flows that are controlled based on time derivative temperature measurements and the preferred locations in the intermediate zones in which those time derivative measurements are taken could vary depending, in part, on the configuration of the heat exchange system and the level of precision desired during cool down.

An exemplary embodiment showing another application of the cool down control method described above is shown in FIG. 3. In this exemplary embodiment, a typical C3MR process is shown. A feed stream 100, which is natural gas in this example, is cleaned and dried by known methods in a pre-treatment section 90 to remove water, acid gases such as $CO_2$ and $H_2S$, and other contaminants such as mercury, resulting in a pre-treated feed stream 101. The pre-treated feed stream 101, which is essentially water free, is pre-cooled in a pre-cooling system 118 to produce a pre-cooled natural gas feed stream 105 and further cooled, liquefied, and/or sub-cooled in a main heat exchanger 108 to produce LNG stream 106. Production control valve 103 can be used to adjust the flow rate of the LNG stream 106. The LNG stream 106 is typically let down in pressure by passing it through a valve (which may be valve 103) or a turbine (not shown) and is then sent to LNG storage tank 109 by stream 104. Any flash vapor produced during the pressure letdown and/or boil-off in the tank is represented by stream 107, which may be used as fuel in the plant, recycled to feed, or vented. In the context of this embodiment, the term "essentially water free" means that any residual water in the pre-treated feed stream 101 is present at a sufficiently low concentration to prevent operational issues associated with water freeze-out in the downstream cooling and liquefaction process.

Figure 3:
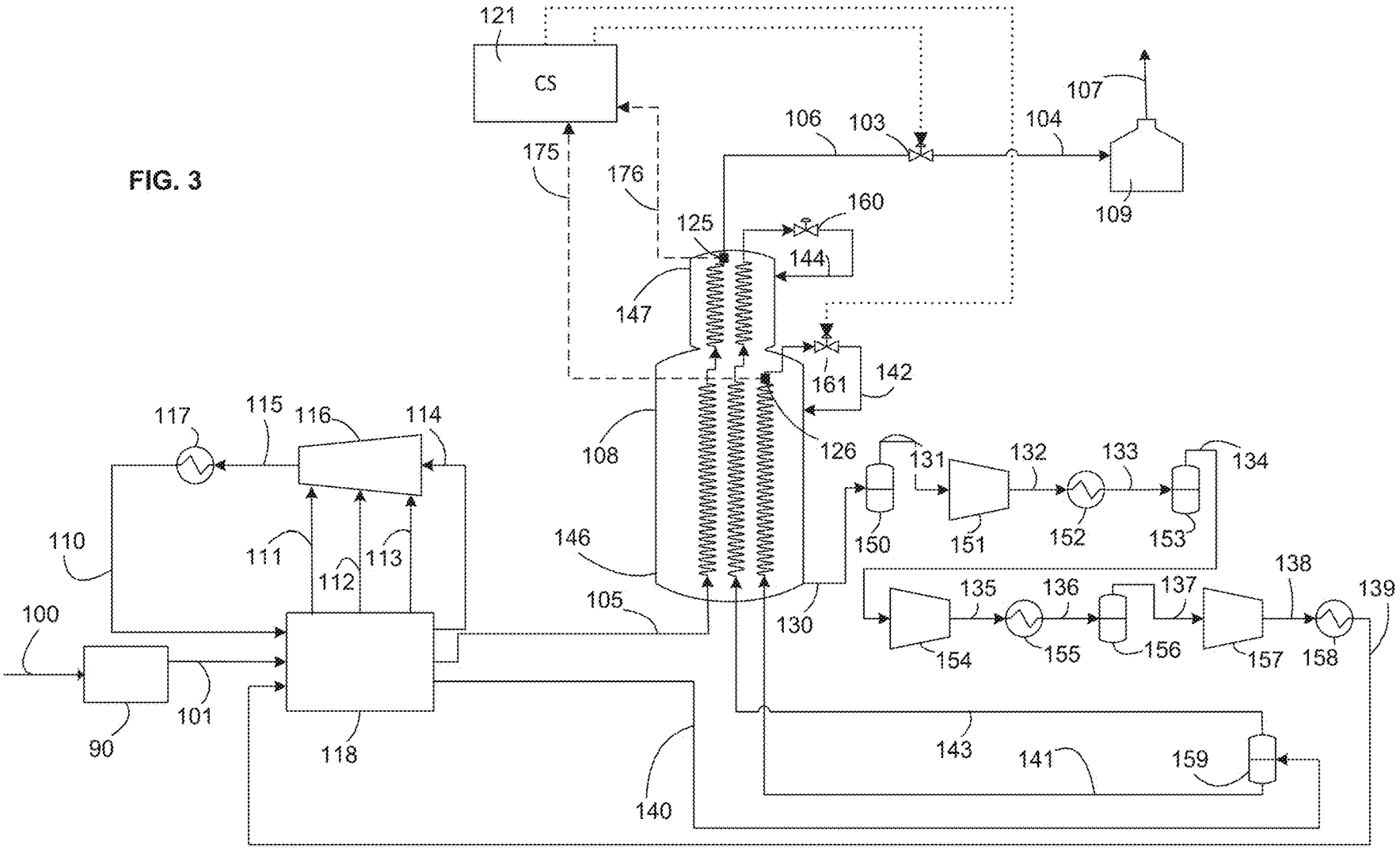
FIG. 3 is a schematic diagram showing an exemplary C3MR natural gas liquefaction system.
Figure 3A:
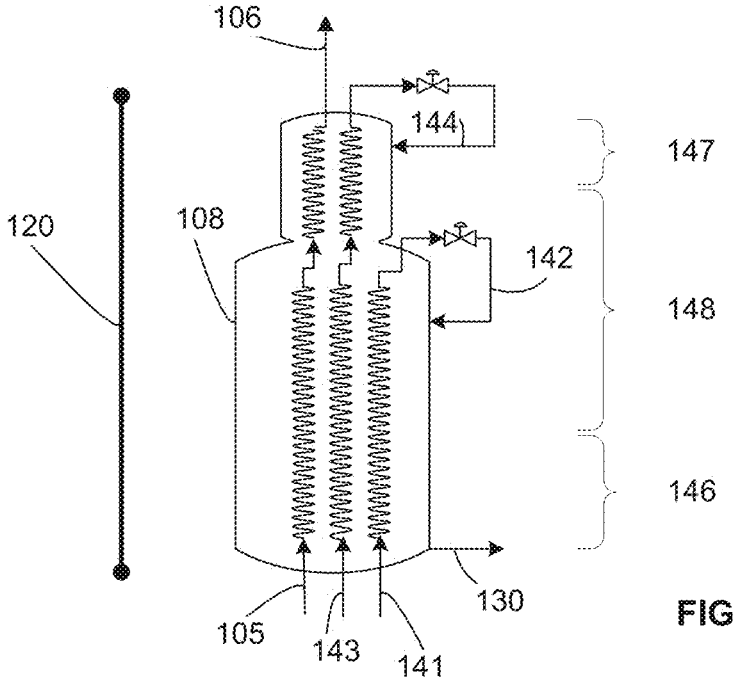
FIG. 3A is a schematic diagram showing the main heat exchanger of C3MR system of FIG. 3.

The pre-treated feed stream 101 is pre-cooled to a temperature below 10 degrees Celsius, preferably below about 0 degrees Celsius, and more preferably about −30 degrees Celsius. The pre-cooled natural gas feed stream 105 is liquefied to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. Main heat exchanger 108 shown in FIGS. 3 and 3A is a coil wound heat exchanger with two bundles. In alternate embodiments, any number of bundles and any suitable exchanger type may be utilized.

The pre-cooling refrigerant used in this C3MR process is propane. Propane refrigerant 110 is warmed against the pre-treated feed stream 101 to produce a warm low pressure propane stream 114. The warm low pressure propane stream 114 is compressed in one or more propane compressors 116 that may comprise four compression stages. Three side streams 111, 112, 113 at intermediate pressure levels enter the propane compressors 116 at the suction of the final, third, and second stages of the propane compressor 116 respectively. The compressed propane stream 115 is condensed in condenser 117 to produce a cold high pressure stream that is then let down in pressure (let down valve not shown) to produce the propane refrigerant 110 that provides the cooling duty required to cool pre-treated feed stream 101 in pre-cooling system 118. The propane liquid evaporates as it warms up to produce warm low pressure propane stream 114. The condenser 117 typically exchanges heat against an ambient fluid such as air or water. Although the figure shows four stages of propane compression, any number of compression stages may be employed. It should be understood that when multiple compression stages are described or claimed, such multiple compression stages could comprise a single multi-stage compressor, multiple compressors, or a combination thereof. The compressors could be in a single casing or multiple casings. The process of compressing the propane refrigerant is generally referred to herein as the propane compression sequence.

In the main heat exchanger 108, at least a portion of, and preferably all of, the refrigeration is provided by vaporizing and heating at least a portion of refrigerant streams after pressure reduction across valves or turbines. A low pressure gaseous MR stream 130 is withdrawn from the bottom of the shell side of the main heat exchanger 108, sent through a low pressure suction drum 150 to separate out any liquids and the vapor stream 131 is compressed in a low pressure (LP) compressor 151 to produce medium pressure MR stream 132. The low pressure gaseous MR stream 130 is typically withdrawn at a temperature near pre-cooling temperature or near ambient temperature if pre-cooling is absent.

The medium pressure MR stream 132 is cooled in a low pressure aftercooler 152 to produce a cooled medium pressure MR stream 133 from which any liquids are drained in medium pressure suction drum 153 to produce medium pressure vapor stream 134 that is further compressed in medium pressure (MP) compressor 154. The resulting high pressure MR stream 135 is cooled in a medium pressure aftercooler 155 to produce a cooled high pressure MR stream 136. The cooled high pressure MR stream 136 is sent to a high pressure suction drum 156 where any liquids are drained. The resulting high pressure vapor stream 137 is further compressed in a high pressure (HP) compressor 157 to produce high-high pressure MR stream 138 that is cooled in high pressure aftercooler 158 to produce a cooled high-high pressure MR stream 139. Cooled high-high pressure MR stream 139 is then cooled against evaporating propane in pre-cooling system 118 to produce a two-phase MR stream 140. Two-phase MR stream 140 is then sent to a vapor-liquid separator 159 from which an MRL stream 141 and a MRV stream 143 are obtained, which are sent back to main heat exchanger 108 to be further cooled. Mixed refrigerant liquid streams leaving phase separators are referred to herein as MRL and mixed refrigerant vapor streams leaving phase separators are referred to herein as MRV, even after they are subsequently liquefied and/or expanded to single- or two-phase. The process of compressing and cooling the MR after it is withdrawn from the bottom of the main heat exchanger 108, then returned to the tube side of the main heat exchanger 108 as multiple streams, is generally referred to herein as the MR compression sequence.

Both the MRL stream 141 and MRV stream 143 are cooled, in two separate circuits of the main heat exchanger 108. The MRL stream 141 is cooled and partially liquefied in the first two bundles of the main heat exchanger 108, resulting in a cold stream that is let down in pressure in MRL pressure letdown valve 161 to produce a two-phase MRL stream 142 that is sent back to the shell-side of main heat exchanger 108 to provide refrigeration required in the first bundle of the main heat exchanger. The MRV stream 143 is cooled in the first and second bundles of main heat exchanger 108, reduced in pressure across the MRV pressure letdown valve 160, and introduced to the main heat exchanger 108 as two-phase MRV stream 144 to provide refrigeration in the sub-cooling, liquefaction, and cooling steps. It should be noted that the MRV and MRL streams 144, 142 may not always be two-phase during the cool down process.

main heat exchanger 108 can be any heat exchanger suitable for natural gas liquefaction such as a coil wound heat exchanger, plate and fin heat exchanger or a shell and tube heat exchanger. Coil wound heat exchangers are the current state of art exchangers for natural gas liquefaction and include at least one tube bundle comprising a plurality of spiral wound tubes for flowing process and warm refrigerant streams and a shell space for flowing a cold refrigerant stream. Referring to FIGS. 3 and 3A, main heat exchanger 108 is a coil wound heat exchanger in which the general direction of flow of the MRV and MRL streams 143, 141 and the pre-cooled natural gas feed stream 105 is parallel to, and in the direction shown by, axis 120. The term "location", as used in the specification and claims in relation to the main heat exchanger 108, means a location along the axial direction of flow of the streams flowing through the main heat exchanger 108, represented in FIG. 3A by axis 120. Similarly, for the main heat exchanger 8 of FIG. 2, "location" means a location along the axial direction of flow of the streams flowing through the main heat exchanger 8, represented in FIG. 2 by axis 20.

As used in the specification and claims, the term "heat exchange system" means all of the components of the main heat exchanger 108, and any conduits that flow through the main heat exchanger 108, plus any conduits that are in fluid flow communication with the main heat exchanger 108 or the conduits that flow through the main heat exchanger 108.

Referring to FIG. 3A, as used in the specification and claims, the term "warm end" means the portion of a heat exchanger (along the axis 120 of feed stream flow) for which the temperature difference from the warmest temperature is less than 10% of the temperature difference between the warmest and coldest temperature provided by the heat exchanger under normal operating conditions. As used in the specification and claims, the term "cold end" means the portion of a heat exchanger (along the axis 120 of feed stream flow) for which the temperature difference from the coldest temperature is less than 10% of the temperature difference between the warmest and coldest temperature provided by the heat exchanger under normal operating conditions. As used in the specification and claims, the term "intermediate zone" means the portion of a heat exchanger (along the axis of feed stream flow) that is located between the cold end and the warm end.

When an element is described as being "at" or "located in" a cold end or warm end, this is intended to mean that the element is located near the cold end (or warm end, depending upon which end is being described) and the temperature difference between the coldest (or warmest, in the case of an element located near the warm end) temperature and the temperature at that element under normal operating conditions is less than 10% of the temperature difference between the warmest and coldest temperature. "At" or "located in" includes conduits that enter or exit the main heat exchanger and meet the applicable temperature requirement. For example, the portion of the conduit through which the LNG stream 106 flows would be considered "at" or "located in" the cold end 147 as long as the difference in temperature between the portion of the conduit and the cold end temperature is less than 10% of the difference between the cold and warm end temperatures.

It should be understood that the present invention could be implemented in other types of natural gas liquefaction processes. For example, processes using a different pre-cooling refrigerant, such as a mixed refrigerant, carbon dioxide (CO2), hydroflurocarbon (HFC), ammonia (NH3), nitrogen (N2), methane (CH4), ethane (C2H6), and propylene (C3H6). In addition, the present invention could also be implemented in processes that do not use pre-cooling, for example, a single mixed refrigerant cycle (SMR). Alternate configurations could be used to provide refrigeration to the main heat exchanger 108. It is preferable that such refrigeration be provided by a closed loop refrigeration process, such as the process used in this embodiment. As used in the specification and claims, a "closed loop refrigeration" process is intended to include refrigeration processes in which refrigerant, or components of the refrigerant may be added to the system ("made-up") during cool down. In other embodiments of the invention, the refrigeration can be provided by an open loop refrigeration process, where the refrigerant is in fluid flow communication with the feed gas, for example where the refrigerant is primarily methane.

Figure 4:
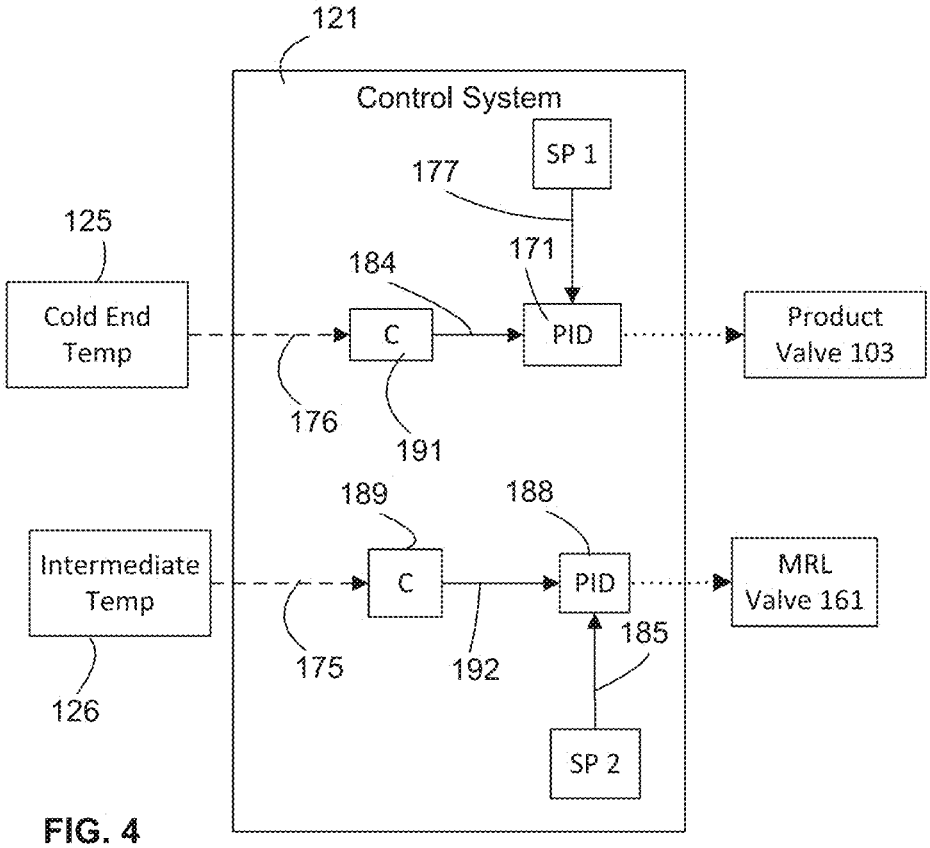
FIG. 4 is a schematic diagram showing an exemplary control system for the system of FIG. 3.

This embodiment includes a control system 121 that manipulates a plurality of process variables, each based on at least one measured process variable and at least one set point. Such manipulation is performed during startup of the process. Sensor inputs and control outputs of the control system 121 are schematically shown in FIG. 4. It should be noted that the control system 121 could be any type of known control system capable of executing the process steps described herein. Examples of suitable control systems include programmable logic controllers (PLC), distributed control systems (DCS), and integrated controllers. It should also be noted that the control system 121 is schematically represented as being located in a single location. It is possible that components of the control system 121 could be positioned at different locations within the plant, particularly if a distributed control system is used. As used herein, the term "automated control system" is intended to mean any of the types of control systems described above in which a set of manipulated variables is automatically controlled by the control system based on a plurality of set points and process variables. Although the present invention contemplates a control system that is capable of providing fully automated control of each of the manipulated variables, it may be desirable to provide for the option for an operator to manually override one or more manipulated variables.

The manipulated variables in this embodiment are the flow rates of the pre-cooled natural gas feed stream 105 (or any other location along the feed stream), the MRL stream 142 (or any other location along the MRL stream), and the MRV stream 144 (or any other location along the MRV stream). The monitored variables in this embodiment are time derivative temperatures at the cold end 147 and at a location in the intermediate zone 148.

A cold end temperature is measured by a temperature sensor 125 located within the main heat exchanger 108 on the conduit through which the feed gas flows. The measured temperature is sent via signal 176 to a derivative calculator 191 that generates a time derivative temperature value. The time derivative temperature value is sent to a PID 171 via signal 184. The PID 171 compares the time derivative temperature value against a set point SP1 (sent via signal 177) and uses this comparison to set the position of valve 103, which controls the flow of the natural gas feed stream 105.

A first intermediate zone temperature is measured by a temperature sensor 126, which is located within the main heat exchanger 108 on the conduit through which the MRL stream 141 flows. The measured temperature is sent via signal 175 to a derivative calculator 189 that generates a time derivative temperature value. The time derivative temperature value is sent to a PID 188 via signal 192. The PID 188 compares the time derivative temperature value against a set point SP2 (sent via signal 185) and uses this comparison to set the position of valve 161, which controls the flow of the MRL stream 142.

The control system 121 is preferably programmed to provide for a short ramp-up time, while maintaining time derivative temperatures within acceptable limits in order to prevent thermal stress. For example the PID 171 could be programmed to gradually open valve 103 until the time derivative of the measured cold end temperature approaches the cold end set point SP1. The PID 171 would then adjust the valve 103 to maintain the time derivative of the measured cold end temperature within a predetermined number of degrees per hour of the cold end set point SP1 without exceeding it. Alternatively, the cold end set point SP1 could be provided as a range and the PID 171 could be programmed to manipulate the valve 103 to maintain time derivative of the measured cold end temperature within the cold end set point SP1 range. Similarly, the PID 188 could be programmed to gradually open valve 161 until the time derivative of the measured intermediate zone temperature approaches the intermediate zone set point SP2. The PID 188 would then adjust the valve 161 to maintain the time derivative of the measured intermediate zone temperature within a predetermined number of degrees per hour of the intermediate zone set point SP2 without exceeding it.

Figure 4A:
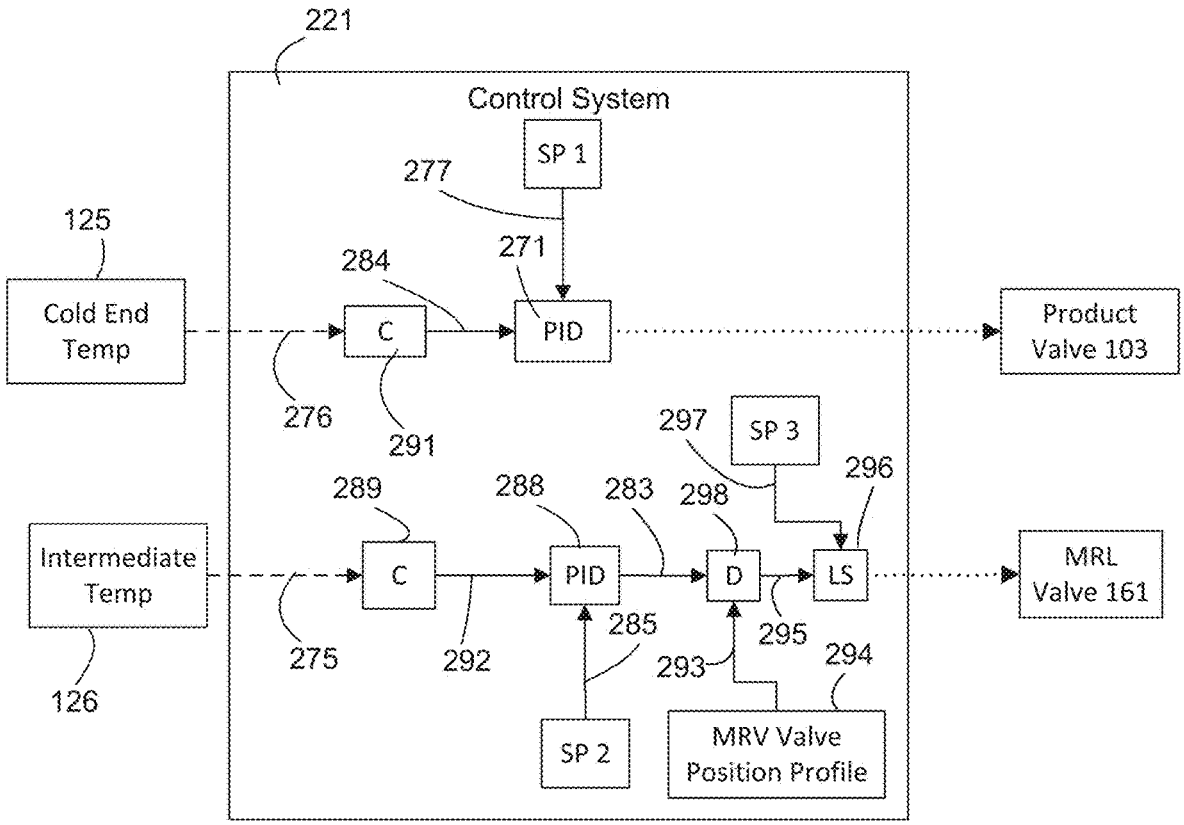
FIG. 4A is a schematic diagram showing a second exemplary control system for the system of FIG. 3.

FIG. 4A shows another exemplary embodiment of a control system 221 to be used with the system shown in FIG. 3. In the control system 221, elements that are identical to elements shown in control system 121 have reference numerals increased by factors of 100 and may not be discussed in the specification. The primary difference in this control system 221 is the way in which the position of the MRL valve 161 is controlled. In this embodiment, the output of the PID 288 (signal 283) is a MRL valve 161/MRV valve 160 position ratio. This ratio is passed to a calculator 298 which converts the ratio to an MRL valve position by multiplying the ratio by the MRV valve position, which is provided to the calculator via signal 293 in accordance with a predetermined profile 294. The MRL valve position is provided via signal 295 to a low-select calculator 296, which adjusts the MRL valve position value to the extent necessary to maintain a rate of change for the MRL valve position at or below SP 3 (provided to the low-select calculator 296 by signal 297). The MRL valve position value is then passed to the MRL valve 161. One benefit of providing the low-select calculator 296 is that it reduces the likelihood of oversupplying MRL refrigerant to the warm and middle sections of the MCHE.

In the specification and claims, when a temperature, pressure, or flowrate is specified as measuring a particular location of interest, it should be understood that the actual measurement could be taken at any location that is in direct fluid flow communication with the location of interest and where the temperature, or pressure, or flow rate is essentially the same as at the location of interest. For example, the cold end temperature measured by sensor 125 at the cold end 147 of the main heat exchanger 108 in FIG. 3 could be measured inside the cold end 147 of the main heat exchanger 108 on the natural gas feed stream 105 (as shown), on the MRV stream 144, or at the LNG stream 106 (outside the main heat exchanger 108), as these locations are essentially at the same temperature. Often, making such measurements at a different location is due to the different location being more convenient to access than the location of interest.

Although FIGS. 2-4 and the associated description above refer to the C3MR liquefaction cycle, the invention is applicable to any other refrigerant type including, but not limited to, two-phase refrigerants, gas-phase refrigerants, mixed refrigerants, pure component refrigerants (such as nitrogen) etc. In addition, it is potentially useful in a refrigerant being used for any service utilized in an LNG plant, including pre-cooling, liquefaction or sub-cooling. The invention may be applied to a compression system in a natural gas liquefaction plant utilizing any process cycle including SMR, DMR, nitrogen expander cycle, methane expander cycle, AP-X, cascade and any other suitable liquefaction cycle.

EXAMPLES

The following represent examples of the simulated application of cool down methods described above to a cold restart of the C3MR system shown in FIGS. 2-4. Cold restarts are usually performed after a plant operation has been stopped for a short period of time. A cold restart differs from warm restarts in the initial main heat exchanger temperature profile and initial MR inventory. For a cold restart, although the warm end 146 temperature of the main heat exchanger 108 is equal to the pre-cooling temperature, the cold end temperature can be any value between the pre-cooling temperature and the normal operating temperature.

In both of the following examples, the cold end temperature cools from 145 degrees K at the beginning of the cool down process to 116 degrees K at the end of the cool down process, the flow rate of the natural gas feed stream is controlled by the cold end set point SP1, and the flow rate of the MRL stream 141 is controlled by the intermediate set point SP2. The flow rate of the MRV stream 143 is set at a predetermined constant ramp rate of 10 kg per hour.

Figure 5:
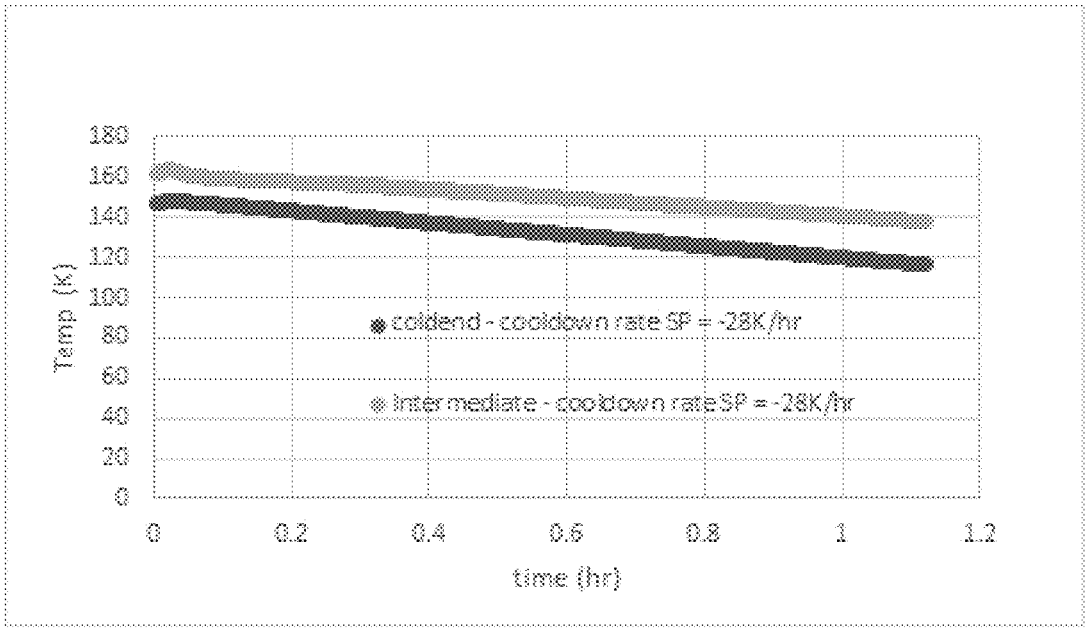
FIG. 5 is a graph showing temperature measurements at the cold end and an intermediate location of the main heat exchanger of FIG. 3 during a first simulated cool down example.
Figure 6:
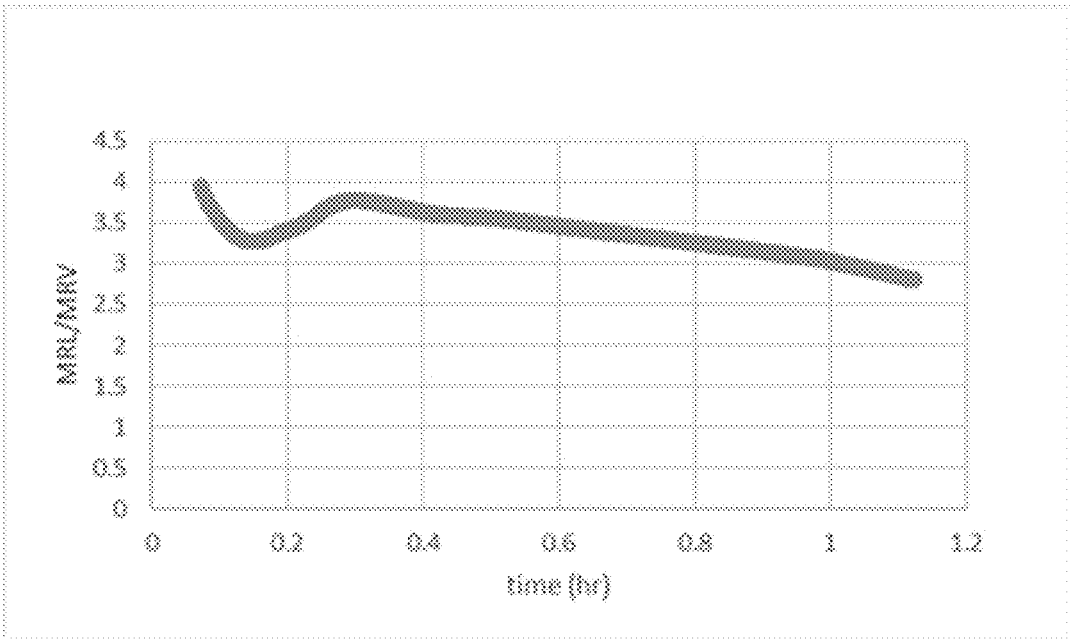
FIG. 6 is a graph showing the ratio of MRL/MRV flow rates during the first simulated cool down example.

In Example 1 (FIGS. 5 and 6), both the cold end set point SP1 and the intermediate set point SP2 are both set at −28 degrees K per hour. Accordingly, the intermediate temperature cools from 160 degrees K at the beginning of the cool down process to 140 degrees K at the end of the cool down process In this example, the ratio between the flow rates of the MRL stream 141 and the MRV stream 143 ("MRL/MRV Ratio") is relatively high (between 2.7 and 4.0 throughout the cool down process), which provides a relatively fast cool down. In addition, the MRL/MRV Ratio also varies (i.e., is not a constant) over the duration of cooldown. This enables enhanced automation of the MRL flow rate during cool down.

Figure 7:
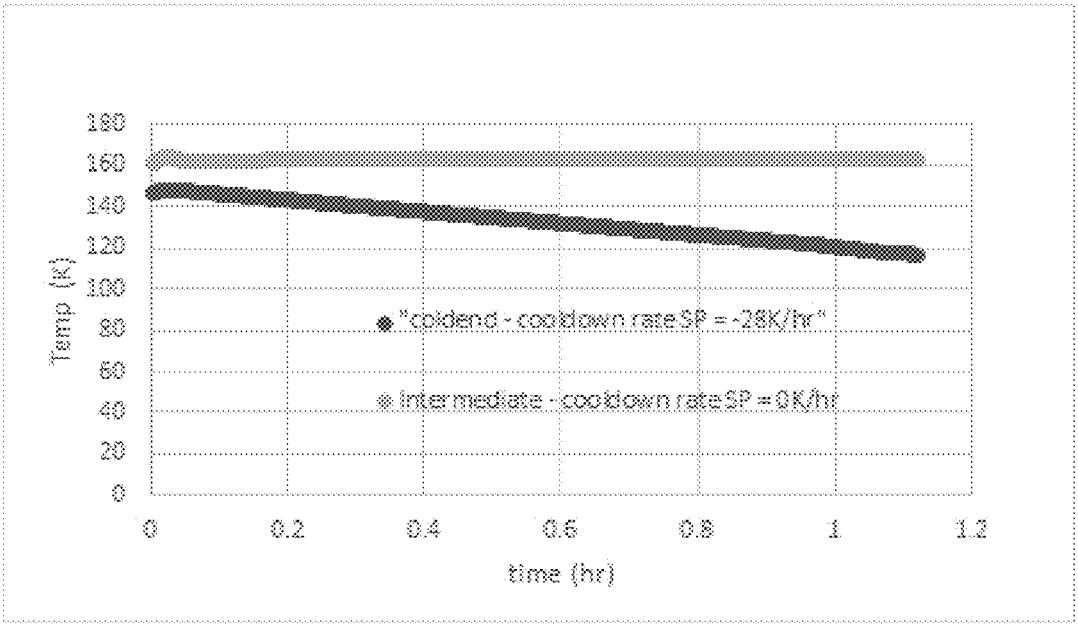
FIG. 7 is a graph showing temperature measurements at the cold end and an intermediate location of the main heat exchanger of FIG. 3 during a second simulated cool down example.
Figure 8:
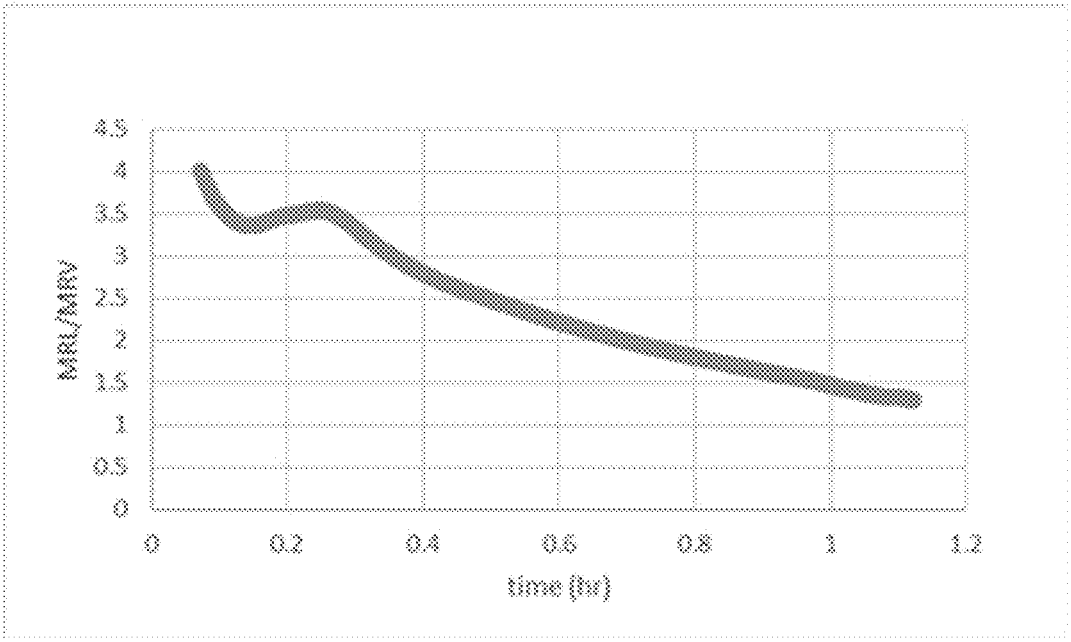
FIG. 8 is a graph showing the ratio of MRL/MRV flow rates during the second simulated cool down example.

In Example 2 (FIGS. 7 and 8), the cold end set point SP1 is set at −28 degrees L per hour and the intermediate set point SP2 is set at 0 degrees K per hour. Accordingly, the intermediate temperature is maintained at 160 degrees K during the cool down process. This example enables the cool down process to be executed with less overall flow from the MRL stream 141, by enabling the MRL/MRV ratio to vary over the duration of cooldown.

An invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method for controlling start-up of a heat exchange system having a main heat exchanger comprising a warm end, a cold end, and an intermediate zone, at least one feed stream, and at least one refrigerant stream, the method comprising the steps of:

(a) cooling the main heat exchanger from a first temperature profile at a first time to a second temperature profile at a second time, the first temperature profile having a first average temperature that is greater than a second average temperature of the second temperature profile; and (b) executing the following steps, in parallel during the performance of step (a):

(i) measuring a cold end temperature at the cold end of the main heat exchanger;

(ii) calculating a first value comprising a rate of change of the first cold end temperature;

(iii) providing a cold end set point representing a preferred rate of change of the cold end temperature;

(iv) controlling a flow rate of the at least one feed stream through the main heat exchanger based on the first value and the cold end set point;

(v) measuring a first intermediate zone temperature at a first location in the intermediate zone of the main heat exchanger;

(vi) calculating a second value comprising a rate of change of the first intermediate zone temperature;

(vii) providing a first intermediate zone set point representing a preferred rate of change of the first intermediate zone temperature; and (viii) controlling a flow rate of a first stream of the at least one refrigerant stream through the main heat exchanger based on the second value and the first intermediate zone set point.

2. The method of claim 1, wherein step (b) further comprises:

(ix) measuring a second intermediate zone temperature at a second location in the intermediate zone of the main heat exchanger, the second location being located at a different axial location in the intermediate zone than the first location;

(x) calculating a third value comprising a rate of change of the second intermediate zone temperature;

(xi) providing a second intermediate zone set point representing a preferred rate of change of the second intermediate zone temperature; and (xii) controlling a flow rate of a second stream of the at least one refrigerant stream through the main heat exchanger based on the third value and the second intermediate zone set point.

3. The method of claim 1, wherein the first intermediate zone set point is equal to the cold end set point.

4. The method of claim 1, wherein the first intermediate zone set point is less than the cold end set point.

5. The method of claim 1, wherein the at least one refrigerant stream comprises an MRL stream and an MRV stream and step (b) further comprises:

(xiii) controlling a flow rate of the MRV stream based on a constant rate of change.

6. The method of claim 5, wherein step (viii) comprises controlling the flow rate of the MRL stream through the main heat exchanger based on the second value and the second set point.

7. The method of claim 1, wherein the main heat exchanger comprises a coil-wound heat exchanger.

8. The method of claim 1, further comprising:

(xiv) pre-cooling the at least one feed stream before introducing the at least one feed stream into the main heat exchanger.

9. The method of claim 1, wherein step (b)(i) comprises:

(i) measuring the cold end temperature at the cold end of the main heat exchanger, the measured cold end temperature consisting of an average of temperature readings from a first plurality of temperature sensors; and wherein step (b)(v) comprises:

(v) measuring the first intermediate zone temperature at the first location in the intermediate zone of the main heat exchanger, the measured first intermediate zone temperature consisting of an average of temperature readings from a second plurality of temperature sensors.

10. The method of claim 1, wherein the cold end set point is constant throughout the performance of step (a).

11. The method of claim 1, wherein the cold end set point changes at least once during the performance of step (a).

12. The method of claim 1, wherein the first intermediate zone set point is constant throughout the performance of step (a).

13. The method of claim 1, wherein the first intermediate zone set point changes at least once during the performance of step (a).

* * * * *